US008138986B2

(12) United States Patent
McMahon

(10) Patent No.: US 8,138,986 B2
(45) Date of Patent: Mar. 20, 2012

(54) DIPOLE ARRAY WITH REFLECTOR AND INTEGRATED ELECTRONICS

(75) Inventor: Stephen E. McMahon, Homer, NY (US)

(73) Assignee: Sensis Corporation, East Syracuse, NY (US)

( * ) Notice: Subject to any disclaimer, the term of this patent is extended or adjusted under 35 U.S.C. 154(b) by 543 days.

(21) Appl. No.: 12/396,983

(22) Filed: Mar. 3, 2009

(65) Prior Publication Data

US 2010/0141530 A1 Jun. 10, 2010

Related U.S. Application Data

(60) Provisional application No. 61/121,296, filed on Dec. 10, 2008.

(51) Int. Cl.
*H01Q 21/00* (2006.01)

(52) U.S. Cl. ..... 343/817; 343/818

(58) Field of Classification Search ..... 343/793, 343/810, 816–821
See application file for complete search history.

(56) References Cited

U.S. PATENT DOCUMENTS

| | | | |
|---|---|---|---|
| 4,001,837 | A | 1/1977 | Regenos et al. |
| 4,121,215 | A | 10/1978 | Barbano |
| 5,032,844 | A | 7/1991 | Hipp et al. |
| 5,237,336 | A | 8/1993 | Jelloul |
| 5,686,928 | A | 11/1997 | Pritchett et al. |
| 5,892,486 | A | 4/1999 | Cook et al. |
| 6,351,246 | B1 | 2/2002 | McCorkle |
| 6,480,168 | B1 | 11/2002 | Lam et al. |
| 6,661,378 | B2 | 12/2003 | Bloy |
| 6,795,424 | B1 | 9/2004 | Kapoor et al. |
| 6,816,120 | B2 | 11/2004 | Kuramoto |
| 6,844,862 | B1 | 1/2005 | Cencich et al. |
| 7,091,841 | B2 | 8/2006 | Adamson et al. |
| 7,180,457 | B2 | 2/2007 | Trott et al. |
| 7,180,461 | B2 | 2/2007 | Petropoulos et al. |
| 7,215,296 | B2 * | 5/2007 | Abramov et al. ..... 343/834 |
| 7,430,407 | B2 | 9/2008 | Smith |

FOREIGN PATENT DOCUMENTS

| | | |
|---|---|---|
| EP | 0 877 443 | 11/1998 |
| GB | 937686 | 9/1963 |
| GB | 1 343 498 | 1/1974 |
| JP | 5-93117 | 12/1993 |
| WO | 97/41622 | 11/1997 |
| WO | 2005/114789 | 12/2005 |

OTHER PUBLICATIONS

Balanis, Constantine; *Antenna Theory, Analysis and Design;* 1982, 2nd Edition, Wiley; pp. 449-454.
Mailloux, Robert J.; *Phased Array Antenna Handbook;* 2005, 2nd Edition, Artech House; pp. 202-220.

* cited by examiner

*Primary Examiner* — Hoang V Nguyen
(74) *Attorney, Agent, or Firm* — Burr & Brown

(57) ABSTRACT

A dipole antenna array comprising a ground plane, at least one dipole antenna including an active antenna element and a grounded antenna element, at least one reflector and integrated electronics, wherein the active antenna element is isolated from the ground plane and extends substantially perpendicular to the ground plane and the grounded antenna element extends in a direction substantially opposite to the active antenna element, the ground plane is contained within the area bounded by the reflector; the integrated electronics include at least one of a signal down converter and a signal up-converter, and at least some of the integrated electronics are contained in a space defined by at least one of a portion of the ground plane and a portion of the reflector.

33 Claims, 7 Drawing Sheets

DIPOLE ARRAY WITH REFLECTOR AND INTEGRATED ELECTRONICS

CROSS-REFERENCE TO RELATED APPLICATIONS

This application claims the benefit of U.S. Provisional Patent Application No. 61/121,296, filed Dec. 10, 2008, the entirety of which is incorporated herein by reference.

FIELD OF INVENTION

The present invention is directed to systems and methods for increasing modularity and portability, improving quality of received and transmitted signals, incorporating functions necessary for a complete system in a compact design, and requiring either narrow band or wide band wireless applications. The present invention is directed to applications for direction finding of wireless signals, systems designed for decoding overlapping signals in time, and systems requiring methods for mitigating multipath signals. The present invention also provides functions for systems requiring repeaters or systems where nodes are utilized to economically extend existing wireless systems with minimal cost of infrastructure.

BACKGROUND OF THE INVENTION

Antennas used for radio communications typically consist of one or more radiating elements. The radiating element can be of different types, including at least a monopole, a dipole and a patch. Each of these types has different advantages and drawbacks.

A dipole is a narrowband antenna exhibiting relatively constant impedance and gain properties over the bandwidth of the dipole antenna. Dipoles are frequently used in low loss antennas. For example, a half-wave dipole can be a single straight radiating element (e.g., conductor) that is one half wavelength long, with a feed in the center. Typically, dipoles are configured with two straight radiating elements that are each one quarter wavelength in length.

A ½-wavelength dipole antenna consists of two ¼-wavelength elements connected at a source. The bottom ¼-wave element is essentially an image of the upper element. A circular antenna pattern is produced by the ½-wave dipole.

Many current designs that incorporate antennas into electronic enclosures are inefficient and narrow band. These devices require higher transmit power and suffer from limited bandwidth as well as reduced receive-sensitivity as a result of the antenna design. These narrow band antennas can also have irregular patterns that decrease efficiency in directions that are usually unknown by the user.

What is needed is a wide band antenna system that incorporates an electronic enclosure into the antenna that improves the received signal strength and reduces the physical size and complexity of the antenna and associated electronics. Further, an antenna system and method that provides an azimuth bearing from the antenna to the source of a signal of interest is needed.

SUMMARY OF THE INVENTION

The system and method of the present invention improves the signal strength received at the integrated electronics and reduces the size and complexity of the antenna by utilizing the physical properties of the ground plane and reflector to enclose the electronics within the antenna of the present invention.

According to a first aspect of the present invention, there is provided a dipole antenna device, comprising a ground plane, at least one dipole antenna comprising a active antenna element isolated from the ground plane and extending in a direction perpendicular to the ground plane and a grounded antenna element extending in a direction substantially opposite to the active antenna element, at least one reflector, wherein the ground plane is contained within the area bounded by the reflector; and integrated electronics comprising at least one of a signal down converter and a signal up-converter, wherein at least some of the integrated electronics are contained in a space defined by at least one of a portion of the ground plane and a portion of the reflector. The frequency range of signals received by the at least one dipole antenna is a function of a physical dimension of the at least one dipole antenna. In some embodiments, all of the integrated electronics are contained in the space defined by at least one of a portion of the ground plane and a portion of the reflector.

In some embodiments of the present invention, the dipole antenna device further comprises at least a first passive element, hereafter referred to as a resonator, located between the active antenna element and the reflector at an equal distance from the active antenna element and a rearmost portion of the reflector opposite the dipole antenna. The frequency bandwidth and Voltage Standing Wave Ratio (VSWR) of the dipole antenna are determined by the physical dimensions of the dipole and the first resonator. More specifically, the height of the at least one dipole antenna is equal to approximately ½ wavelength of the lowest frequency and the height of the resonator, which is approximately ½ wavelength of the highest frequency, and the bandwidth of the signals received is a function of the diameter of the dipole element and the one or more resonators.

In some embodiments, the first resonator comprises one of an active or passive resonator element that is isolated from the ground plane and extends in the same direction from the ground plane as the active dipole antenna element, and a grounded resonator element that extends in a direction directly opposite to the active or passive resonator element in the orthogonal ground plane.

In some embodiments, the dipole antenna comprises at least one material selected from metals, metallic coated plastic and printed circuit board material that includes at least one conductive layer. The active antenna element of the dipole is isolated from the ground plane using a material having a low dielectric constant. In some embodiments, the first resonator is also isolated from the ground plane with a material having a low dielectric constant. In some embodiments, the isolator material has a dielectric constant of less than 5. In some embodiments, the thickness of the isolator above the ground plane in the dipole antenna device for the active dipole element is less than ⅛ the wavelength of the highest frequency received by the dipole antenna element.

In some embodiments, the integrated electronics are powered from an external source in some embodiments of the invention, and the integrated electronics are powered by batteries contained within the dipole antenna device in other embodiments. In some embodiments, the integrated electronics further comprise one or more of a digital compass, and an external interface and software to interface with a handheld device. The handheld devices include at least one device selected from smart phones, PDAs and laptops.

Further, in some embodiments, the system and method of the present invention provides an azimuth bearing from the antenna of the source of a signal of interest. In some embodiments, the integrated electronics and associated software determines the azimuth to the source of a transmitted signal from signal amplitude and signal phase of the transmitted signal measured at two adjacent dipole antenna elements. In these embodiments, the integrated electronics compares a signal amplitude and a signal phase of a transmitted signal received at a dipole antenna of the at least one dipole antenna that receives the highest signal amplitude and a signal amplitude and a signal phase of a transmitted signal received at a dipole antenna receiving the next highest signal amplitude that is adjacent to the dipole antenna receiving the highest signal amplitude to determine an azimuth of a source of the transmitted signal from the dipole antenna device. In some embodiments, the integrated electronics down-convert the received signals to an intermediate frequency before processing to determine the azimuth to the source of the signal.

In other embodiments, the integrated electronics compares the signal phase of the transmitted signal received at the dipole antenna receiving the highest signal amplitude, the signal phase of the transmitted signal received at a dipole antenna adjacent to the dipole antenna receiving the highest amplitude having the second highest signal amplitude and the signal phase of the transmitted signal received at a dipole antenna adjacent to the dipole antenna receiving the highest amplitude having the third highest signal amplitude to increase the accuracy of the azimuth estimate of the source of the transmitted signal.

In some embodiments, an elevation angle to the source of the transmittal signal from the antenna is also determined from the received signal at multiple antenna elements.

In some embodiments, the integrated electronics further comprise a signal transmitter that is embedded within the space defined in part by at least one of a portion of the ground plane and a portion of the reflector. In other embodiments, the integrated electronics include another wireless transmit and receive capability located on a peripheral boundary of the reflector such that it does not interfere with the antenna pattern of the dipole antenna device.

In some embodiments, a portion of the ground plane and a portion of the reflector define a space for an integrated electronics enclosure, having a thickness sufficient to contain the integrated electronics at least in a direction parallel to the ground plane without adversely affecting the beam pattern of the dipole antenna device. The antenna-to-integrated electronics signal path of the invention has a loss of less than 0.5 dB.

In one mode of operation of the invention, the integrated electronics scan through a plurality of user selectable frequency bands within the frequency range of signals received by the dipole antenna element. In another mode, the user can select a particular frequency band within the frequency range of signals received by the dipole antenna element.

In some embodiments, the dipole antenna device further comprises another dipole antenna that is a known distance in terms of wavelength from the dipole antenna receiving the highest signal amplitude and provides multipath discrimination based on a signal amplitude and a signal phase of a transmitted signal received by the another dipole antenna. In other embodiments, the dipole antenna device includes a plurality of dipole antennas having known dimensions of separation and orientation with respect to the dipole antenna receiving the highest signal amplitude that provides multipath discrimination based on a signal amplitude and a signal phase of a signal received by one or more of the plurality of dipole antennas having known dimensions of separation and orientation with respect to the dipole antenna receiving the highest signal amplitude. In these embodiments, the adjacent dipole antennas are separated by about one quarter wavelength to less than one wavelength of the main frequency of the dipole antenna to prevent ambiguity of phase.

In some embodiments, the dipole antenna device further comprises a radome made of a material having a low dielectric constant that covers the dipole antenna device.

In some embodiments of the dipole antenna device, two or more dipole antenna devices are vertically stacked separated by a distance of about one half wavelength of the dipole antenna. In other embodiments, two or more dipole antenna devices are stacked separated by a distance of greater than two wavelengths of the dipole antenna. In yet other embodiments, two or more dipole antennas are formed in a diamond shape.

In other embodiments, two or more dipole antennas are formed in a linear manner with the reflector of each dipole antenna angled 45 degrees with respect to the angle of the dipole antenna device.

According to a second aspect of the present invention, there is provided a circular dipole antenna array, comprising at least two dipole antennas, each dipole antenna comprising an active antenna element and an opposing grounded antenna element, at least one reflector, wherein the at least one reflector divides a volume covered by the circular dipole antenna array into two or more sectors and one dipole antenna of the at least two dipole antennas is provided in each of the two or more sectors; integrated electronics comprising at least one of a signal down-converter and a signal up-converter, wherein at least some of the integrated electronics are contained in a space defined in part by at least one of a portion of the ground plane and a portion of the reflector. The frequency range of signals received by the circular dipole antenna is a function of a physical dimension of the dipole antenna element. In some embodiments, all of the integrated electronics are contained in the space defined by at least one of a portion of the ground plane and a portion of the reflector.

In some embodiments, the circular dipole antenna device further comprises at least a first resonator located between an active dipole antenna element and the reflector at an equal distance from the active dipole antenna element and a rearmost portion of the reflector opposite the active dipole antenna. The frequency bandwidth and Voltage Standing Wave Ratio (VSWR) of the dipole antenna are determined by a physical dimension of the first resonator. More specifically, the height of the dipole antenna is equal to approximately ½ wavelength of the lowest frequency and the height of the combined elements of the resonator is approximately ½ wavelength of the highest frequency, and the bandwidth of the signals received is a function of the diameter of the dipole element and the one or more resonators.

In some embodiments, the first resonator comprises one of an active or passive resonator element that is isolated from the ground plane and extends in the same direction from the ground plane as the active dipole antenna element, and a grounded resonator element that extends in a direction directly opposite to the active or passive resonator element in the orthogonal ground plane.

In some embodiments, the dipole antenna comprises at least one material selected from metals, metallic coated plastic and printed circuit board material that includes at least one conductive layer. The active antenna element is isolated from the ground plane using a material having a low dielectric constant. In some embodiments, the first resonator is also isolated from the ground plane with a material having a low dielectric constant.

In some embodiments, the thickness of the isolator above the ground plane in the dipole antenna device for the active element is less than ⅛ the wavelength of the highest frequency received by the dipole antenna. The isolator material has a dielectric constant of less than 5.

In one mode of operation of the invention, the integrated electronics scan through a plurality of user selectable frequency bands within the frequency range of signals received by the dipole antenna. In another mode, the user can select a particular frequency band within the frequency range of signals received by the dipole antenna.

In some embodiments, the integrated electronics are powered from an external source in some embodiments of the invention. In other embodiments, the integrated electronics are powered by batteries contained within the dipole antenna device. In some embodiments, the integrated electronics further comprise one or more of a digital compass, and an external interface and software to interface with a handheld device. The handheld devices include at least one device selected from smart phones, PDAs and laptops.

In some embodiments, the integrated electronics and associated software determines the azimuth to the source of a transmitted signal from signal amplitude and signal phase of the transmitted signal measured at two adjacent dipole antennas. In these embodiments, the integrated electronics compares a signal amplitude and a signal phase of a transmitted signal received at a dipole antenna of the at least one dipole antenna that receives the highest signal amplitude and a signal amplitude and a signal phase of a transmitted signal received at a dipole antenna receiving the next highest signal amplitude that is adjacent to the dipole antenna receiving the highest signal amplitude to determine an azimuth of a source of the transmitted signal from the dipole antenna device. In some embodiments, the integrated electronics down-convert the received signals to an intermediate frequency before processing to determine the azimuth to the source of the signal. In some embodiments, an elevation angle to the source of the transmitted signal from the antenna is also determined from the received signal at multiple antennas.

In other embodiments, the integrated electronics compares the signal phase of the transmitted signal received at the dipole antenna receiving the highest signal amplitude, the signal phase of the transmitted signal received at a dipole antenna adjacent to the dipole antenna receiving the highest amplitude having the second highest signal amplitude and the signal phase of the transmitted signal received at a dipole antenna adjacent to the dipole antenna receiving the highest amplitude having the third highest signal amplitude to increase the accuracy of the azimuth estimate of the source of the transmitted signal.

In some embodiments, the circular dipole antenna device further comprises another dipole antenna that is a known distance in terms of wavelength from the dipole antenna receiving the highest signal amplitude and provides multipath discrimination based on a signal amplitude and a signal phase of a transmitted signal received by the another dipole antenna. In other embodiments, the circular dipole antenna device includes a plurality of dipole antennas having known dimensions of separation and orientation with respect to the dipole antenna receiving the highest signal amplitude that provides multipath discrimination based on a signal amplitude and a signal phase of a signal received by one or more of the plurality of dipole antennas having known dimensions of separation and orientation with respect to the dipole antenna receiving the highest signal amplitude. The adjacent dipole antennas are separated by about one quarter wavelength to less than one wavelength of the main frequency of the dipole antenna to prevent ambiguity of phase.

In some embodiments, the integrated electronics further comprise a signal transmitter that is embedded within the space defined in part by at least one of a portion of the ground plane and a portion of the reflector. In other embodiments, the integrated electronics include another wireless transmit and receive capability located on a peripheral boundary of the reflector such that it does not interfere with the antenna pattern of the dipole antenna device.

In some embodiments, the signal from the signal transmitter is selectably distributed to one or more of the dipole antennas of the dipole antenna array. In other embodiments, the signal transmitter comprises a signal transmitter for each dipole antenna.

In some embodiments, a portion of the ground plane and a portion of the reflector define a space for an integrated electronics enclosure, having a thickness sufficient to contain the integrated electronics at least in a direction parallel to the ground plane without adversely affecting the beam pattern of the dipole antenna device. The antenna-to-integrated electronics signal path of the invention has a loss of less than 0.5 dB.

In some embodiments of the circular dipole antenna device, two or more dipole antenna devices are vertically stacked separated by a distance of about one half wavelength of the dipole antenna. In other embodiments, two or more dipole antenna devices are stacked separated by a distance of greater than two wavelengths of the dipole antenna. In yet other embodiments, two or more dipole antennas are formed in a diamond shape.

In other embodiments, two or more dipole antennas are formed in a linear manner with the reflector of each dipole antenna angled 45 degrees with respect to the angle of the dipole antenna device. In some embodiments, the circular dipole antenna device further comprises a radome made of a material having a low dielectric constant that covers the circular dipole antenna device.

According to a third aspect of the present invention, there is provided a method of determining an azimuth of the source of a transmitted signal from a dipole antenna array, the method comprising, receiving a transmitted signal at more than one dipole antenna of the dipole antenna array, determining the dipole antenna receiving the highest signal amplitude, determining the adjacent dipole antenna element receiving the next highest signal amplitude, determining an azimuth to the source of the transmitted signal from the dipole antenna array by comparing the signal amplitude and signal phase of the transmitted signal received at each of the two adjacent dipole antenna elements receiving the highest signal amplitude, interfacing with a handheld device, and displaying the azimuth to the source of the transmitted signal from the dipole antenna array on the handheld device display.

In some embodiments, the method further comprises scanning through a plurality of user selectable frequency bands within the frequency range of signals received by the dipole antenna array. In other embodiments, the method further comprises selecting a particular frequency band within the frequency range of signals received by the dipole antenna array.

In some embodiments, the method further comprises measuring the received signal amplitude and signal phase at another dipole antenna that is a known distance in terms of wavelength from the dipole antenna receiving the highest signal amplitude and providing multipath discrimination based on a signal amplitude and a signal phase of a transmitted signal received by the another dipole antenna. In other embodiments, the method further comprises comparing the signal amplitude and signal phase of the signal received at the dipole antenna receiving the highest signal amplitude, the signal phase of the transmitted signal received at a dipole antenna adjacent to the dipole antenna receiving the highest amplitude having the second highest signal amplitude and the signal phase of the transmitted signal received at a dipole antenna adjacent to the dipole antenna receiving the highest amplitude having the third highest signal amplitude to increase the accuracy of the azimuth estimate of the source of the transmitted signal.

In some embodiments, the method further comprises transmitting the determined azimuth of the source of the transmitted signal via a signal transmitter embedded with the shielded area. Changing the size of the one or more resonators alters the antenna sensitivity at a particular frequency band within the frequency range of signals received by the dipole antenna array.

According to a fourth aspect of the present invention, there is provided a dipole antenna device, comprising a ground plane, at least one dipole antenna comprising a active dipole antenna element isolated from the ground plane and extending in a direction perpendicular to the ground plane and a balun fed dipole extending in a direction substantially opposite to the active dipole antenna element having an electrical center of the balanced feed to the dipole antenna at the same voltage potential as the orthogonal ground plane, wherein a frequency range of signals received by said at least one dipole antenna is a function of a physical dimension of said at least one dipole antenna, at least one reflector, wherein the ground plane is contained within the area bounded by the reflector and integrated electronics comprising at least one of a signal down converter and a signal up-converter, wherein at least some of the integrated electronics are contained in a space defined by at least one of a portion of the ground plane and a portion of the reflector.

BRIEF DESCRIPTION OF THE DRAWINGS

For a fuller understanding of the nature and objects of the invention, reference should be made to the following detailed description of a preferred mode of practicing the invention, read in connection with the accompanying drawings in which.

DETAILED DESCRIPTION OF THE INVENTION

Figure 1:
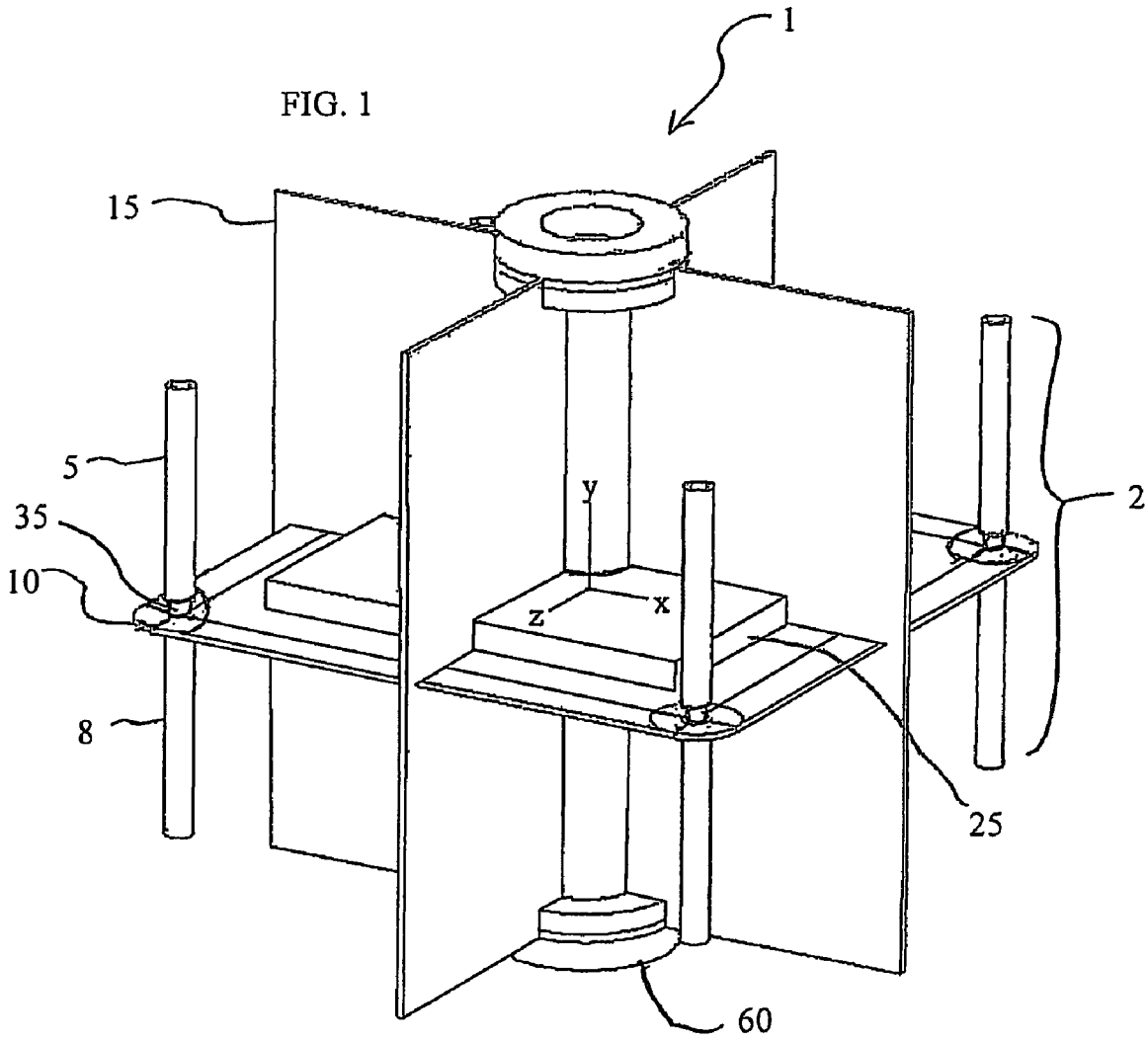
FIG. 1 depicts a perspective view of a circular dipole antenna/reflector array with ground plane electronics of the present invention.

The ½ wave dipole is a classic antenna element with the signal generator, such as a transceiver, located at the midpoint having the bottom half of the wire common to the grounded side and the top half connected to the source. The radius of the active dipole element used in the dipole antenna will determine the bandwidth of the signal to be transmitted or received. A reflector added in parallel to the element increases the antenna gain in the direction opposite the reflector in relation to the element. Within the symmetry of the center of the element and the reflector, there is a plane common to the ground point of the generator. The present invention uses this plane to incorporate the electronic circuitry necessary for the purpose of receiving, transmitting, decoding, and any other function which utilizes these signals and other system requirements. Also, the reflector is used to incorporate electronic circuitry. Also, multiple elements and reflectors are placed to create a circular array which provides a symmetric plane that is shared by the elements and used to incorporate electronic circuitry.

The expression "substantially perpendicular" as used herein, means that at least 90% of the points in a structure characterized as being substantially perpendicular to a reference plane are located on one of or between a pair of planes that are (1) perpendicular to the reference plane, (2) parallel to each other, and (3) spaced from each other by a distance of not more that 50% of the largest dimension of the structure. The expression "substantially opposite" as used herein, means that at least 80% of the points in a structure characterized as extending substantially opposite to another structure are located on one of or between a pair of planes extending from the other structure that are (1) parallel to each other, and (2) spaced from each other by a distance of not more that 50% of the largest dimension of the structure. The term "approximately" as used herein, means that the value of a parameter that is characterized as being "approximately" equal to a second value is between 0.95 and 1.05 times the second value.

The dipole antenna device of the present invention comprises a ground plane, at least one dipole antenna comprising a active antenna element isolated from the ground plane and extending in a direction perpendicular to the ground plane and a grounded antenna element extending in a direction substantially opposite to the active antenna element, at least one reflector, wherein the ground plane is contained within the area bounded by the reflector; and integrated electronics comprising at least one of a signal down converter and a signal up-converter, wherein at least some of the integrated electronics are contained in an integrated electronics enclosure that is defined by at least one of a portion of the ground plane and a portion of the reflector.

In some embodiments, all of the integrated electronics are contained in the space defined by at least one of a portion of the ground plane and a portion of the reflector. The present invention combines the image of the monopole antenna over a ground plane and the circular pattern of the dipole antenna element to create a beam pattern that permits the use of a portion of the ground plane for containing some or all of the electronic components of the dipole array with reflector and integrated electronics. Having the associated electronics integrated within the footprint of the antenna in the present invention is advantageous because it provides the shortest path possible between the received signal output port of the dipole antenna and the integrated electronics, thereby reducing signal loss and improving the signal-to-noise (SNR) ratio of the dipole antenna device.

The dipole antenna comprises at least one material selected from metals, metallic coated plastic and printed circuit board material that includes at least one conductive layer. Examples of dipole antenna configurations include but are not limited to ¼ wave dipole, a ½ wave dipole, folded dipole, and J-pole. In some embodiments of the invention, the dipole antenna can also include a balun, which is a type of transformer that is used to isolate the signal transmission line to provide a balanced output signal.

In a first embodiment of the present invention shown in FIG. 1, the dipole antenna device 1 comprises ground plane 10, at least one dipole antenna 2 comprising a active antenna element 5 and a grounded antenna element 8 that extends in a direction substantially opposite to the active antenna element 5 below ground plane 10. As shown in FIG. 1, the dipole antenna device 1 further comprises at least one reflector 15 and an integrated electronics enclosure 25 that is contained in a space defined by at least one of a portion of ground plane 10 and a portion of reflector 15.

The dipole antenna device 1 can also include one or more resonators 30 located between active antenna element 5 and reflector 15. Referring to FIG. 1, resonator 30 can be either an active or passive resonator element. Resonator 30 is isolated from the ground plane by isolator 40 and extends in the same direction from ground plane 10 as active antenna element 5. The frequency bandwidth and Voltage Standing Wave Ratio (VSWR) of the dipole antenna are determined by the physical dimensions of the dipole and the first resonator. Changing the size of the resonator alters the antenna sensitivity at a particular frequency band within the frequency range of signals received by the dipole antenna. More specifically, the height of the at least one dipole antenna is equal to approximately ½ wavelength of the lowest frequency and the height of the resonator, which is approximately ½ wavelength of the highest frequency, and the bandwidth of the signals received is a function of the diameter of the dipole element and the one or more resonators. In this embodiment, resonator 30 can be positioned at an equal distance from active antenna element 5 and a rearmost portion of reflector 15 opposite active antenna element 5, as shown in FIG. 1, or closer to either active antenna element 5 or the rearmost portion of the reflector 15.

Figure 2:
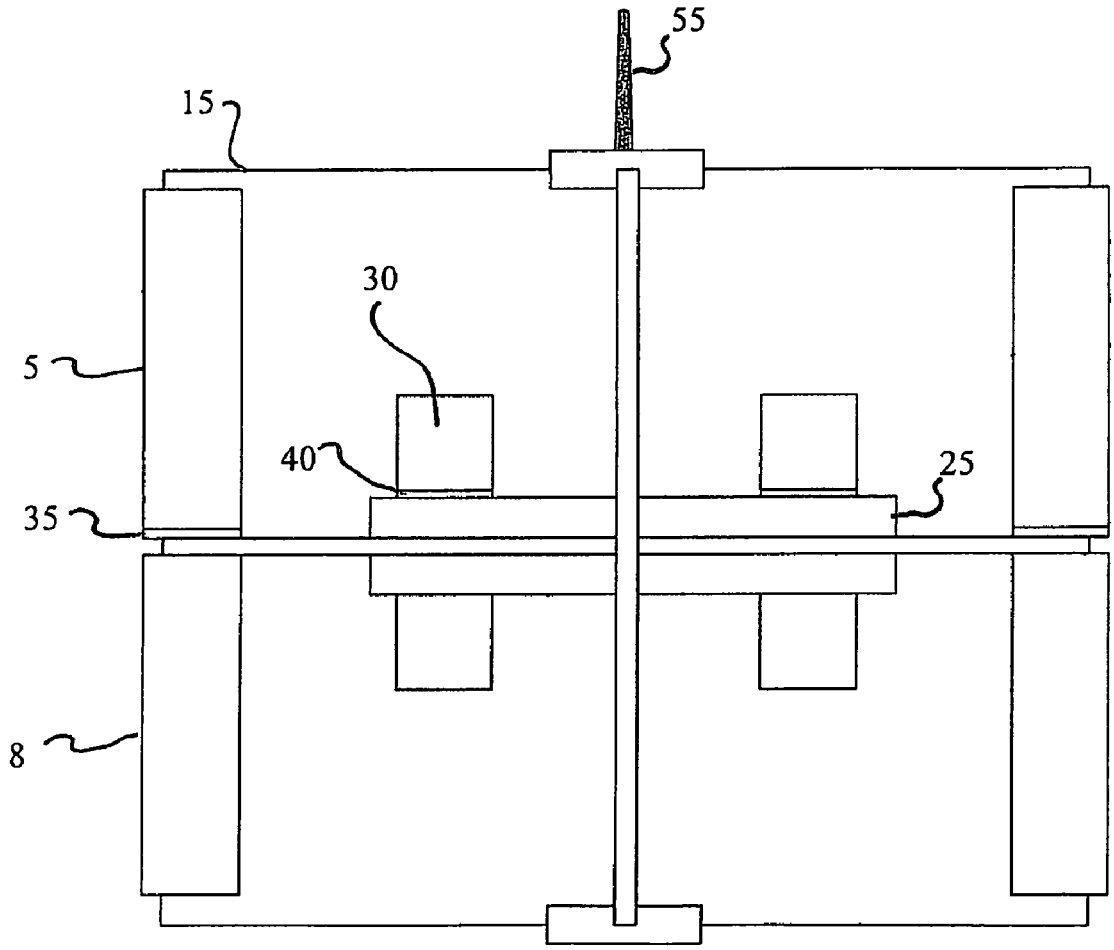
FIG. 2 depicts a side view of the circular dipole antenna/reflector array with ground plane electronics and resonator

As shown in FIG. 2, the active element of the dipole antenna is isolated from the ground plane by isolator 35, which is formed from a material having a low dielectric constant and low loss tangent. The first resonator, which is shown in FIG. 2, is also isolated from the ground plane by isolator 40, which is formed from a material having a low dielectric constant and low loss tangent. The isolator material has a dielectric constant of less than 5. In a preferred embodiment, the isolator material has a dielectric constant between 2 and 3.5. In some embodiments, the thickness of isolator 35 above the ground plane is less than ⅛ the wavelength of the highest frequency received by active dipole antenna element 5.

In some embodiments, reflector 15 is formed of at least one material selected from metals, metallic coated plastic and printed circuit board material that includes at least one conductive layer. In some embodiments, reflector 15 can be squarely shaped defining multiple sectors with a dipole antenna present in each of the defined sectors. For example, reflector 15 can be sectored into four 90 degree sectors as shown in FIG. 1. Other configurations for reflector 15 include but are not limited to curved, acutely angled and obtusely angled (i.e., greater than 90 degrees but less than or equal to 180 degrees).

In some embodiments, the dipole antenna device 1 also includes a radome made of a material having a low dielectric constant that covers the dipole antenna device.

In some embodiments, a portion of ground plane 10 and a portion of reflector 15 define a space for an integrated electronics enclosure 25 having a thickness sufficient to contain the integrated electronics at least in a direction parallel to the ground plane without adversely affecting the beam pattern of the dipole antenna device. The antenna-to-integrated electronics signal path of the invention has a loss of less than 0.5 dB.

In some embodiments, the integrated electronics 20 can also include a signal transmitter 50 that is embedded within the integrated electronics enclosure 25 defined in part by at least one of a portion of ground plane 10 and a portion of reflector 15. In some embodiments, the integrated electronics 20 include another wireless transmit and receive capability 55 located on a peripheral boundary of the reflector such that it does not interfere with the antenna pattern of the dipole antenna device.

The frequency range of signals received by the at least one dipole antenna is a function of the physical dimensions of the at least one dipole antenna. Adjusting the size and shape of the antenna elements provides the present invention the ability to cover a wide range of frequency bandwidths and provides the capability for narrowband operation over different frequency bands of interest. For example, in some embodiments of the invention, the dipole antenna is configured to cover frequencies from approximately 800 MHz to 2.0 GHz. In other embodiments, the dipole antenna is configured to cover frequencies from approximately 2.4 GHz to 5.6 GHz, and in other embodiments, the dipole antenna is configured to cover frequencies from approximately 300 MHz to 800 MHz, for example. However, the present invention is not limited to these exemplary frequency ranges.

In some embodiments of the present invention, the dipole antenna is configured as a circular dipole antenna array, as shown in FIG. 1. The circular dipole antenna array comprising at least two dipole antennas, each dipole antenna 2 comprising an active antenna element 5 and an opposing grounded antenna element 8, at least one reflector 15, wherein the at least one reflector 15 divides a volume covered by the circular dipole antenna array into two or more sectors and one dipole antenna 2 of the at least two dipole antennas is provided in each of the two or more sectors; integrated electronics comprising at least one of a signal down-converter and a signal up-converter, wherein at least some of the integrated electronics are contained in an integrated electronics enclosure 25 that is defined in part by at least one of a portion of ground plane 10 and a portion of reflector 15. In some embodiments, the circular dipole antenna array includes four dipole antennas 2 and reflector 15 is shaped to isolate the four dipole antennas in four sectors of approximately 90 degrees each, as shown in FIG. 1.

The height of dipole antennas 5 and 8 determines the main frequency of dipole antenna 2 and the diameter of dipole elements 5 and 8 and resonators 30 and 31 determine the bandwidth of the signals received by the dipole antenna device 1. In this embodiment, the signal frequency enhanced by resonator 30 is approximately two times the main frequency of active dipole element 5. In some embodiments, a single resonator 30 is positioned at the midpoint between active dipole element 5 and the rearmost portion of reflector 15.

In other embodiments of the invention, multiple resonators 30 are positioned between active dipole element 5 and the rearmost portion of reflector 15. The position of each resonator 30 with respect to active dipole element 5 and the rearmost portion of reflector 15 determine the signal frequency enhanced by that resonator as a ratio of the main frequency. For example, if resonator 30 is positioned closer to the rearmost portion of reflector 15 than active dipole element 5, the signal frequency enhanced by the resonator is a ratio of the main frequency that is more than two times the main frequency of active dipole element 5. Conversely, if resonator 30 is positioned closer to active dipole element 5, the signal frequency enhanced by the resonator is a ratio of the main frequency that is less than two times the main frequency of active dipole element 5.

The frequency bandwidth and Voltage Standing Wave Ratio (VSWR) of the dipole antenna are determined by a physical dimension of resonator 30. More specifically, the height of the at least one dipole antenna is equal to approximately ½ wavelength of the lowest frequency and the height of the resonators approximately ½ wavelength of the highest frequency and the bandwidth of the signals received is a function of the diameter of the dipole element and the resonator 30.

In one mode of operation of the invention, the integrated electronics scan through a plurality of user selectable frequency bands within the frequency range of signals received by the dipole antenna element. In another mode, the user can select a particular frequency band within the frequency range of signals received by the dipole antenna element.

The integrated electronics are powered from an external source in some embodiments of the invention, and the integrated electronics are powered by batteries contained within the dipole antenna device 1 in other embodiments. The integrated electronics further comprise one or more of a digital compass, and an external interface and software to interface with a handheld device. The handheld devices include at least one device selected from smart phones, PDAs and laptops.

The integrated electronics and associated software determines the azimuth to the source of a transmitted signal from signal amplitude and signal phase of the transmitted signal measured at two adjacent dipole antenna elements. In some embodiments, the integrated electronics down-convert the received signals to an intermediate frequency before processing to determine the azimuth to the source of the signal. In some embodiments, the integrated electronics compares a signal amplitude and a signal phase of a transmitted signal received at a dipole antenna that receives the highest signal amplitude and a signal amplitude and a signal phase of a transmitted signal received at a dipole antenna receiving the next highest signal amplitude that is adjacent to the dipole antenna receiving the highest signal amplitude to determine an azimuth of a source of the transmitted signal from the dipole antenna device.

In other embodiments, the integrated electronics compares the signal phase of the transmitted signal received at the dipole antenna receiving the highest signal amplitude, the signal phase of the transmitted signal received at a dipole antenna adjacent to the dipole antenna receiving the highest amplitude having the second highest signal amplitude and the signal phase of the transmitted signal received at a dipole antenna adjacent to the dipole antenna receiving the highest amplitude having the third highest signal amplitude to increase the accuracy of the azimuth estimate of the source of the transmitted signal.

The dipole antenna device 1 can also include another dipole antenna 2 that is a known distance in terms of wavelength from the dipole antenna receiving the highest signal amplitude and provides multipath discrimination based on a signal amplitude and a signal phase of a transmitted signal received by the another dipole antenna. In other embodiments, the dipole antenna device includes a plurality of dipole antennas having known dimensions of separation and orientation with respect to the dipole antenna receiving the highest signal amplitude that provides multipath discrimination based on a signal amplitude and a signal phase of a signal received by one or more of the plurality of dipole antennas having known dimensions of separation and orientation with respect to the dipole antenna receiving the highest signal amplitude. In FIG. 1, the antenna directly opposite to the antenna receiving the highest signal amplitude provides the multipath discrimination. The adjacent dipole antennas are separated by about one quarter wavelength to about one half wavelength of the main frequency of the dipole antenna to prevent ambiguity of phase.

In some embodiments, an elevation angle to the source of the transmitted signal from the antenna is also determined from the received signal at multiple antenna elements. The elevation angle to the source of the transmitted signal is determined from the difference in phase and amplitude of the received signal at multiple antenna elements. For example, the phase and amplitude of the received signal will be the same at each antenna element when the source of the signal is either directly above or directly below the dipole antenna array. When the source of the transmitted signal is located at a distance from the dipole antenna array, the signal received at each antenna element will have differences in at least one of signal phase and amplitude.

Figure 3:
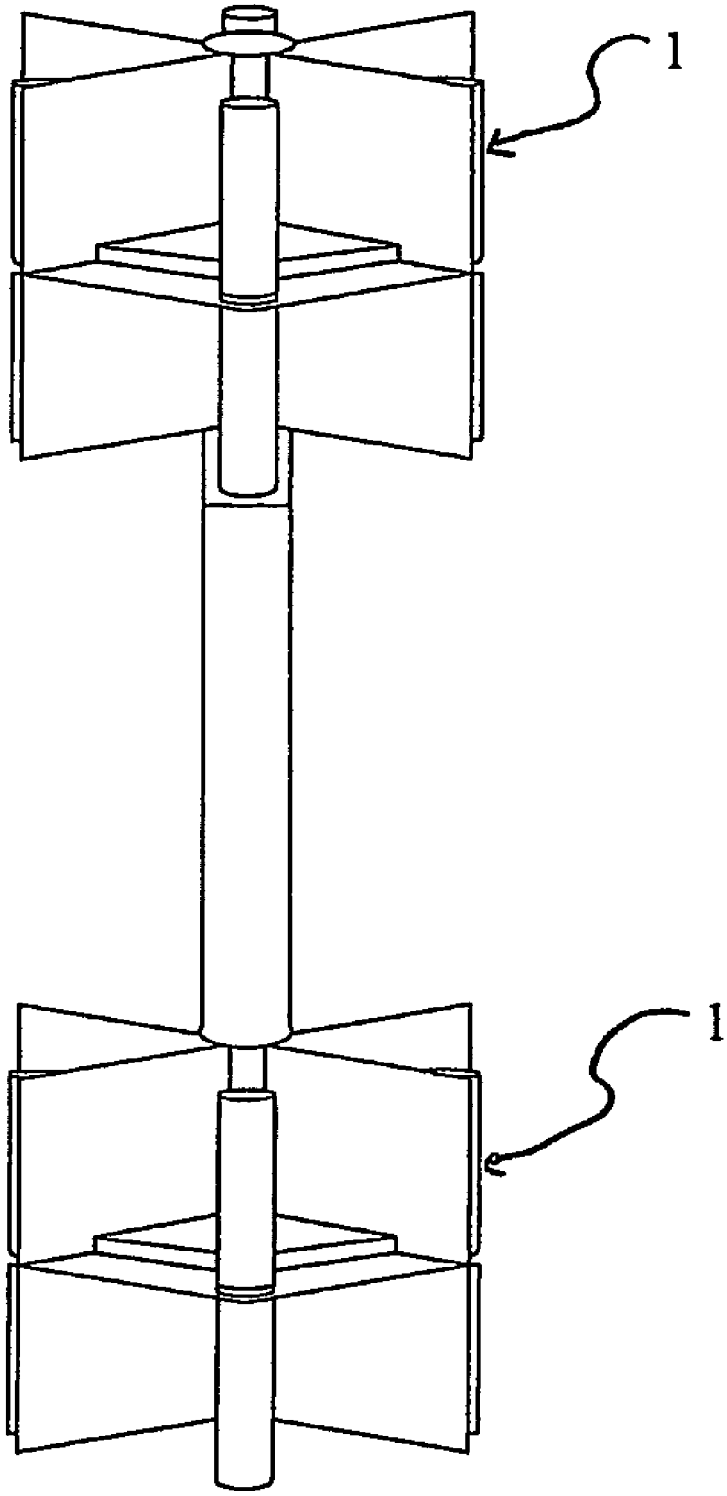
FIG. 3 depicts a perspective view of two circular dipole antennas in a stacked configuration.

In addition, multiple dipole antenna devices can be used to triangulate the position of a source of a signal of interest and thus provide a range estimate. In some embodiments of the dipole antenna device 1, two or more dipole antenna devices are vertically stacked separated by a distance of about one half wavelength of the dipole antenna, as shown in FIG. 3. In other embodiments, two or more dipole antenna devices are stacked separated by a distance of greater than two wavelengths of the dipole antenna. In yet other embodiments, two or more dipole antennas are formed in a diamond shape.

Figure 4:
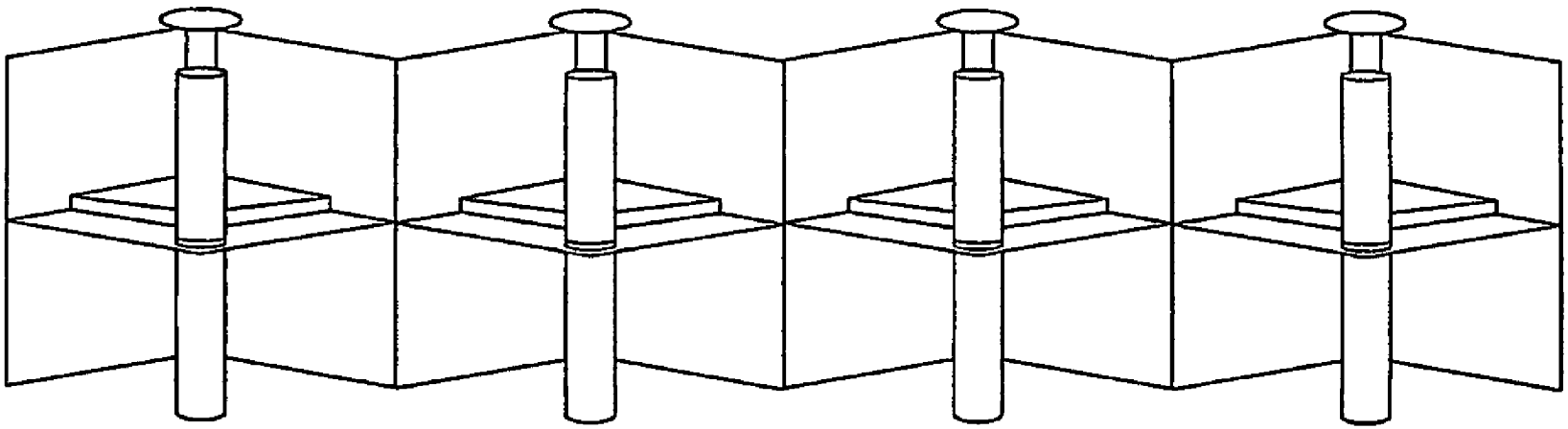
FIG. 4 depicts a perspective view of multiple dipole antennas formed in a planar array with the reflector of each dipole antenna angled 45 degrees with respect to the angle of the dipole antenna device of the present invention.

In other embodiments, two or more dipole antennas are formed in a linear manner with the reflector of each dipole antenna angled 45 degrees with respect to the angle of the dipole antenna device, as shown in FIG. 4.

The present invention provides a method of determining an azimuth to a source of a transmitted signal from a dipole antenna array, the method comprising, receiving a transmitted signal at more than one dipole antenna elements of the dipole antenna array, determining the dipole antenna element receiving the highest signal amplitude, determining the adjacent dipole antenna element receiving the next highest signal amplitude, determining an azimuth to the source of the transmitted signal from the dipole antenna array by comparing the signal amplitude and signal phase of the transmitted signal received at each of the two adjacent dipole antenna elements receiving the highest signal amplitude, interfacing with a handheld device, and displaying the azimuth to the source of the transmitted signal from the dipole antenna array on the handheld device display.

In some embodiments, the method further comprises scanning through a plurality of user selectable frequency bands within the frequency range of signals received by the dipole antenna array. In other embodiments, the method further comprises selecting a particular frequency band to scan within the frequency range of signals received by the dipole antenna array.

In other embodiments the method further comprises measuring the received signal amplitude and signal phase at another dipole antenna that is a known distance in terms of wavelength from the dipole antenna receiving the highest signal amplitude and providing multipath discrimination based on a signal amplitude and a signal phase of a transmitted signal received by the another dipole antenna. The method further comprises comparing the signal amplitude and signal phase of the signal received at the dipole antenna receiving the highest signal amplitude, the signal phase of the transmitted signal received at a dipole antenna adjacent to the dipole antenna receiving the highest amplitude having the second highest signal amplitude and the signal phase of the transmitted signal received at a dipole antenna adjacent to the dipole antenna receiving the highest amplitude having the third highest signal amplitude to increase the accuracy of the azimuth estimate of the source of the transmitted signal.

In some embodiments, the method further comprises transmitting the determined azimuth of the source of the transmitted signal via a signal transmitter embedded with the shielded area. In some embodiments, the method further comprises determining an elevation angle to the source of the transmitted signal from the antenna using the received signal at multiple antenna elements.

In one embodiment, the present invention comprises a dipole antenna device, comprising a ground plane, at least one dipole antenna comprising a active dipole antenna element isolated from the ground plane and extending in a direction perpendicular to the ground plane and a balun fed dipole extending in a direction substantially opposite to the active dipole antenna element having an electrical center of the balanced feed to the dipole antenna at the same voltage potential as the orthogonal ground plane, wherein a frequency range of signals received by said at least one dipole antenna is a function of a physical dimension of said at least one dipole antenna, at least one reflector, wherein the ground plane is contained within the area bounded by the reflector and integrated electronics comprising at least one of a signal down converter and a signal up-converter, wherein at least some of the integrated electronics are contained in a space defined by at least one of a portion of the ground plane and a portion of the reflector.

In this embodiment, the dipole antenna array is a compact, lightweight, highly integrated multi-channel receiver designed for determining the azimuth direction of a wireless device, such as cell and satellite phones. This embodiment includes 4 dipole antenna elements with reflectors, and integrated electronics layer that fit within a fiberglass radome shell that measures 6"×6"×6". The dipole antenna array includes an external device interface.

In this embodiment, the following features were chosen to maintain portability, while providing the desired accuracy. More specifically, the integrated dipole elements were chosen for their simplicity and small size. In this embodiment, the dipole elements and reflectors are simple structures that require minimal machining and are easy to assemble.

The wide frequency band that is necessary to receive signals from ~800 MHz to 2000 MHz, for example, is a challenge for many traditional antenna types. Wideband antennas are relatively large, such as the Vivaldi horn and cone shaped spirals. Increasing the diameter of the simple dipole increases the bandwidth up to a certain point, as known in the art. In the present invention, the dipole antenna minimizes the signal return loss at part of the frequency band to provide the necessary SNR to receive and determine an azimuth, or line of bearing to a signal source located some distance away from the dipole antenna device. For example, in the present invention, limiting return loss to 3 dB at part of the frequency band provides the dipole antenna device sufficient sensitivity to meet the signal to noise requirement necessary to detect signals transmitted tip to 1 km away from the antenna device. In this embodiment, utilizing reflectors behind each dipole antenna in the dipole antenna device directs the signal into this quadrant, without excessive side or back lobes which can cause ambiguity.

The symmetry of the 4 dipole element array shown in FIG. 1 is all that is necessary to provide 360 degrees of coverage. Based on the symmetry of the dipole antenna, the dipole antenna array can detect and determine the azimuth to the source of the signal throughout the entire 360 degree antenna circumference.

In this embodiment, the integrated electronics include 5 filter banks in each of the 4-channel receivers. This embodiment specifically monitors signal transmissions in the following cell phone frequency bands: 800 MHz, 900 MHz, 1800 MHz and 1900 MHz (uplink cell phone band). The $5^{th}$ band is the 1625 MHz uplink satellite band. Users can select to continuously monitor and one of these 5 bands or can selectively scan through two or more of these frequency bands to intercept any activity in the selected frequency bands. The specific frequency bands monitored can be changed by changing the size of the active dipole antenna element.

In this embodiment, the integrated electronics includes surface mount Low Noise Amplifiers (LNAs) with high bandwidth, high gain, low noise figure (<2 dB) and low DC supply voltage and small physical footprints. The integrated electronics are contained on one or more multi-layered printed circuit boards and incorporate features such as blind vias and vias under pads. In this embodiment, the integrated electronics incorporate the RF and digital components onto a single board. For example, the top of the board essentially contains the RF and IF components and the bottom of the board contain the digital components to include a high performance field programmable gate array (FPGA), memory, communications interface and RF control. Blind vias are necessary to prevent digital noise from leaking on to the RF circuitry and to provide more area for the surface mount components on each side of the PCB.

In this embodiment, the integrated electronics uses the digitally converted IF signal to determine the receive signal strength. If the unit is in an area where high power signals are present, the active devices will be shut down temporarily to avoid damage. The dipole antenna array samples the IF directly into the processor in the integrated electronics. This provides more accurate phase information and reduces the number of down conversions. In this embodiment, the ADC chosen for this design is a 12-bit, 170 Msps component. Each channel has its own ADC and the simultaneous samples are clocked into an FPGA. Traditional narrow band protective circuitry cannot be placed at the receiver front end for protection due to the wide bandwidth that is down converted. The signal in each band of interest is down converted to an IF center frequency of ~40 MHz with 75 MHz of band width. In this embodiment, wide band VCO/PLLs are used to down convert the signal band of interest. In this embodiment, the reference oscillator has a frequency stability of +/−100 ppb and less than +/−200 Hz. at 1900 MHz. band.

In some embodiments, a completely integrated synthesizer, is used as part of the integrated electronics. In other embodiments, multiple PLLs and VCOs are used. Most embodiments of the present invention also include a high performance reference oscillator to decompose the received signals to an accurate frequency. For example, this embodiment has a =/−6.5 degree accuracy in azimuth with a 19 dB SNR and 20 samples.

Figure 5:
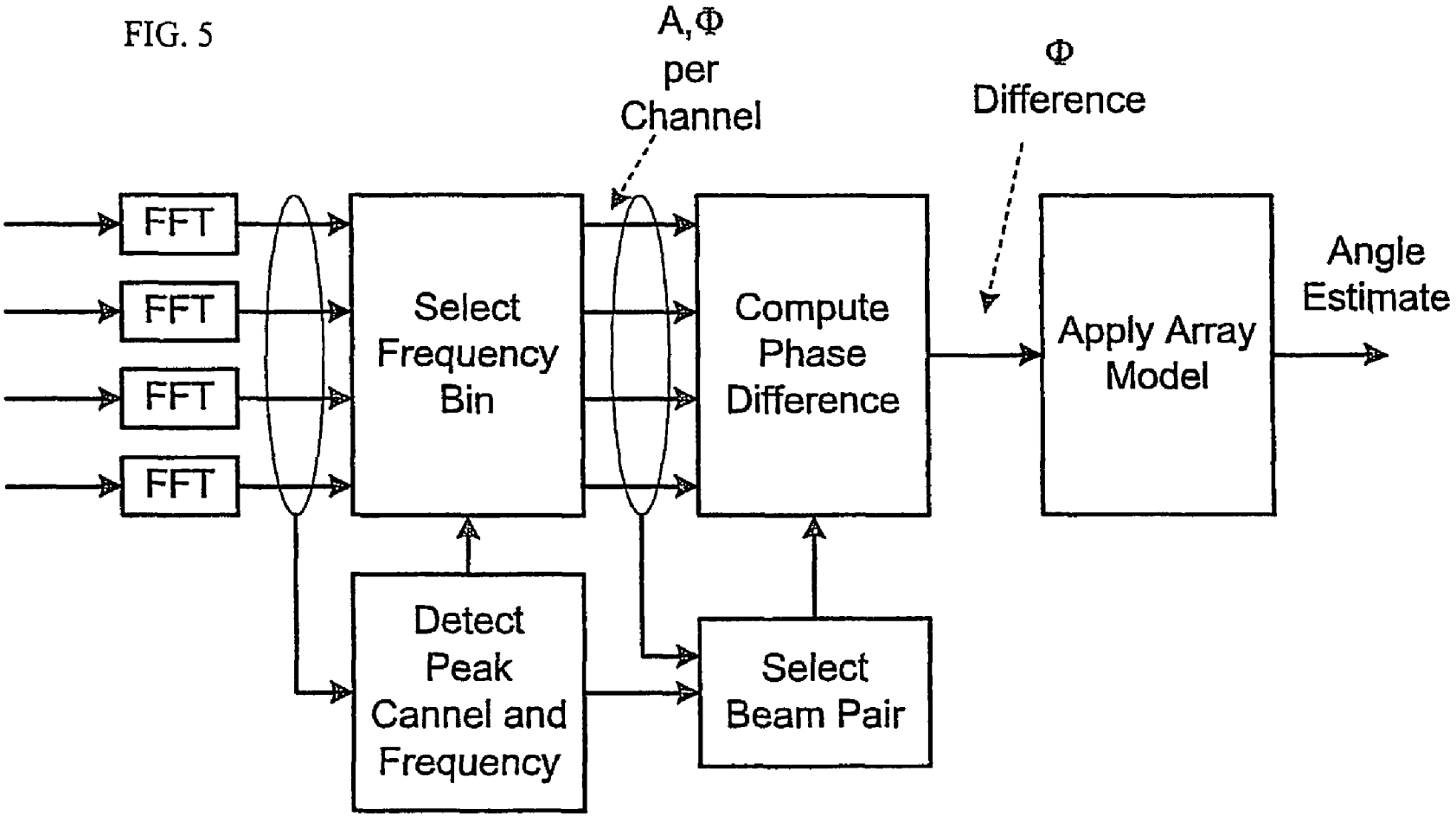
FIG. 5 shows one example of a processing block diagram for the front end processing in one embodiment of the present invention.
Figure 6:
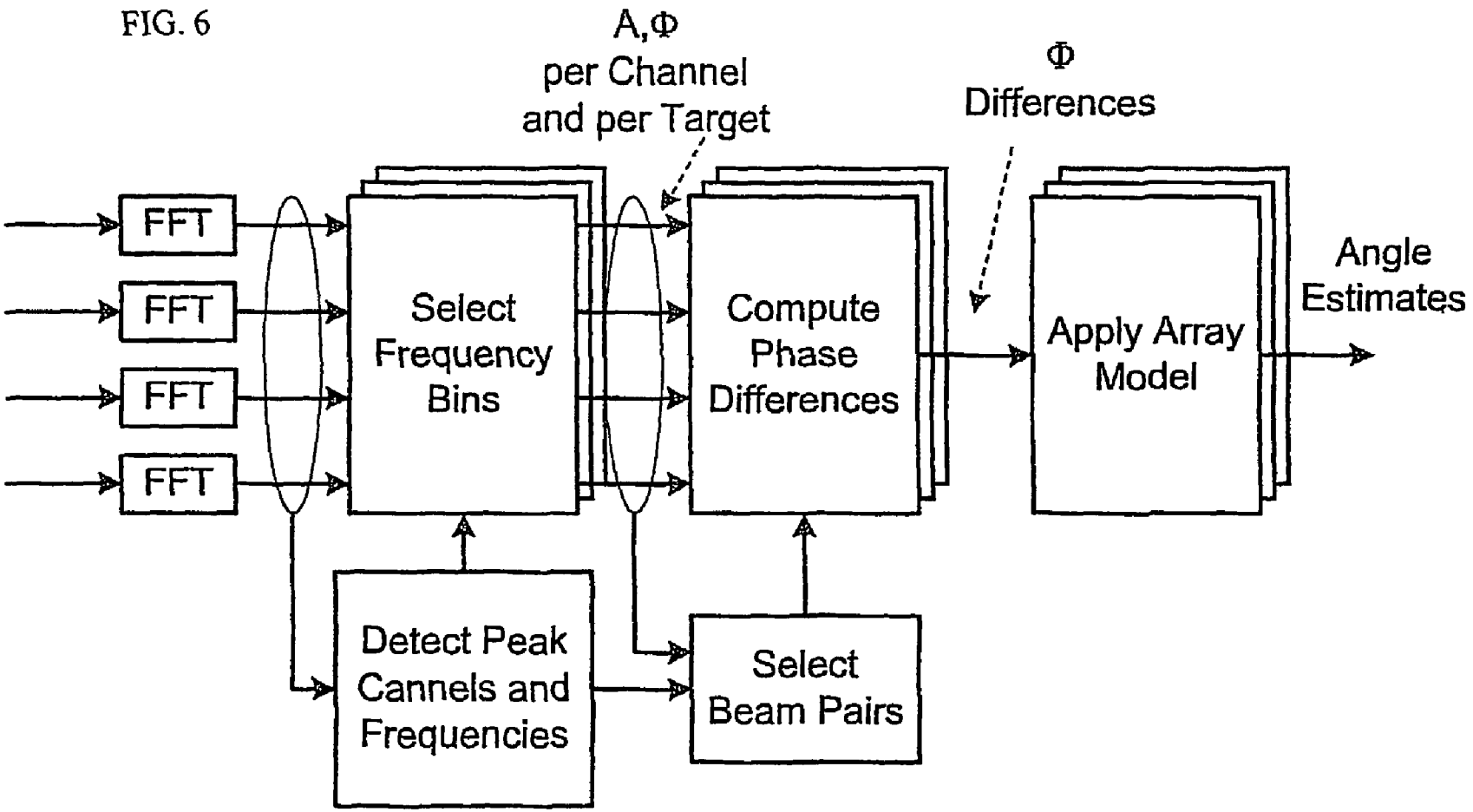
FIG. 6 shows another example of a processing block diagram for the front end processing of multiple cell phones separated in frequency.
Figure 7:
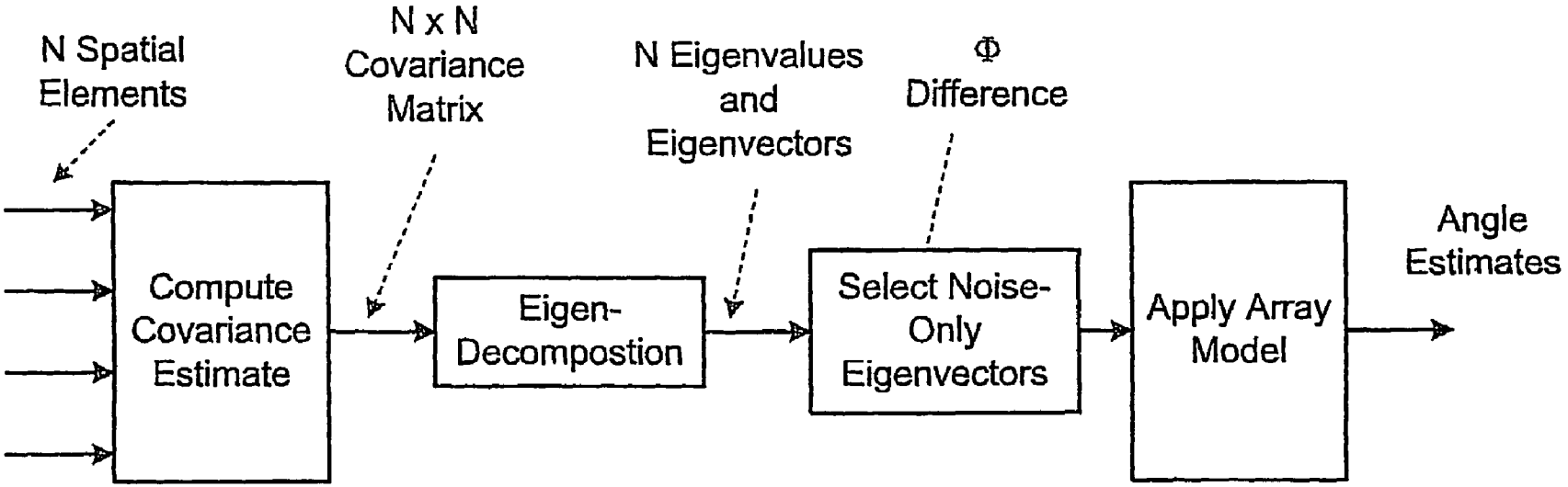
FIG. 7 shows one example of a processing block diagram for the determination of azimuth of the source of multiple simultaneously received signals using the Multiple Signal Classification (MuSiC) algorithm.

In this embodiment, the FPGA contains discrete digital elements that are designed using VHDL and at least one processing core that will run embedded software. Portions of the design are divided between the 2 types of logic based on timing requirements and processing efficiency. For example, Fourier transforms may be implemented as in logic blocks in VDHL. Control for the RF logic is performed in the core processor. By using a digital version of the phase/magnitude comparison IC, the dipole antenna array provides users with real-time information. One example of the front end processing flow diagram of the present invention is shown in FIG. 5. In the flow diagram of FIG. 5, algorithms running in the FPGA detect peak channel and frequency in the selected frequency bins, selects beam pairs, computes phase difference between the antenna elements and then applies the array model to estimate the angle to the source of the transmitted signal from the antenna. FIG. 6 depicts another embodiment of a flow diagram showing the processing for multiple cell phones that are separated in frequency. FIG. 7 shows another example of the processing block diagram for determining the azimuth and elevation of multiple, simultaneously received signals using the MuSiC algorithm. In this example, the final calculation for azimuth and elevation incorporates data provided by an electronic compass. This electronic compass also provides 3-axis data. GPS receiver electronics may also be incorporated to provide the user with location data. Users that combine data from multiple units can be provided a range estimate of the received signal of interest through triangulation.

In this embodiment, since most or all of the processing will be done within the space provided for the integrated electronics, the band width of the output signal is relatively low. In this embodiment, an RS-422 serial bus connection connects to the external user interface. In other embodiments, a different type of wired connection, or a wireless connection, such as bluetooth, is used to communicate to the user interface. This is a common interface used on many portable or stationary products, including a PDA and laptop personal computer. Utilizing the ability for multiple devices to share information, the range estimate can be provided by triangulation.

In some embodiments, the dipole antenna elements, 5 and 8, and reflector 15 are protected from the external environment by a protective radome. The protective radome is formed using a low-dielectric constant material. In this embodiment, the radome is an opaque, rigid, thermo-set vinyl material that is easy to machine. If more protection is required, a thin rigid fiberglass coating is applied to the protective radome as the final external layer. The dipole antenna array also includes a metal flange connection 60 for fitting to a mast, tripod or other mounting structure, with the same stand off is located at both the top and bottom of the array. In this configuration, the communication cable and power cable is fed through the flange to the mast on the bottom. A small transmitter can be attached to the flange mounted at the top with a small monopole antenna integrated with this transmitter to supply a test signal for each element to adjust its amplitude and phase for calibration, as required. Given the compactness and of the design, this calibration feature should not be necessary. Production test methods will include element-to-element calibration.

It will be understood that various modifications and changes may be made in the present invention by those of ordinary skill in the art who have the benefit of this disclosure. All such changes and modifications fall within the spirit of this invention, the scope of which is measured by the following appended claims.

I claim:

1. A dipole antenna device, comprising:

a ground plane;

at least one dipole antenna comprising an active antenna element and a grounded antenna element, the active antenna element being isolated from the ground plane and extending in a direction substantially perpendicular to the ground plane, the grounded antenna element extending in a direction substantially opposite to the active antenna element, wherein a frequency range of signals received by said at least one dipole antenna is a function of a physical dimension of said at least one dipole antenna;

at least one reflector, wherein at least a portion of the ground plane is contained within an area substantially bounded by the reflector; and integrated electronics comprising at least one of a signal down converter and a signal up-converter, wherein at least some of the integrated electronics are contained in a space defined by at least one of a portion of the ground plane and a portion of the reflector, wherein the integrated electronics and associated software determine the azimuth to the source of a transmitted signal from signal amplitude and signal phase of the transmitted signal measured at two adjacent dipole antenna elements.

2. The dipole antenna device of claim 1, wherein all of the integrated electronics are contained in said space.

3. The dipole antenna device of claim 1, wherein the dipole antenna comprises at least one material selected from metals, metallic coated plastic and printed circuit board material that includes at least one conductive layer.

4. The dipole antenna device of claim 1, wherein the integrated electronics are powered from an external source.

5. The dipole antenna device of claim 1, wherein the integrated electronics are powered by batteries contained within the dipole antenna device.

6. The dipole antenna device of claim 1, wherein the integrated electronics down-convert a received signal to an intermediate frequency.

7. The dipole antenna device of claim 1, the integrated electronics further comprising a digital compass.

8. The dipole antenna device of claim 1, further comprising an external interface and software to interface with a handheld device.

9. The dipole antenna device of claim 8, wherein the handheld device comprises at least one device selected from smart phones, PDAs and laptops.

10. The dipole antenna device of claim 1, wherein the integrated electronics scan through a plurality of user selectable frequency bands within a frequency range of signals received by said at least one dipole antenna.

11. The dipole antenna device of claim 1, wherein the user can select a particular frequency band within the frequency range of signals received by said at least one dipole antenna.

12. The dipole antenna device of claim 1, wherein the integrated electronics compares a signal amplitude and a signal phase of a transmitted signal received at a dipole antenna of the at least one dipole antenna that receives the highest signal amplitude and a signal amplitude and a signal phase of a transmitted signal received at a dipole antenna receiving the next highest signal amplitude that is adjacent to the dipole antenna receiving the highest signal amplitude to determine an azimuth of a source of the transmitted signal from the dipole antenna device.

13. The dipole antenna device of claim 12 further comprising another dipole antenna that is a known distance in terms of wavelength from the dipole antenna receiving the highest signal amplitude and provides multipath discrimination based on a signal amplitude and a signal phase of a transmitted signal received by the another dipole antenna.

14. The dipole antenna device of claim 12, wherein the integrated electronics compares the signal phase of the transmitted signal received at the dipole antenna receiving the highest signal amplitude, the signal phase of the transmitted signal received at a dipole antenna adjacent to the dipole antenna receiving the highest amplitude having the second highest signal amplitude and the signal phase of the transmitted signal received at a dipole antenna adjacent to the dipole antenna receiving the highest amplitude having the third highest signal amplitude to increase the accuracy of the azimuth estimate of the source of the transmitted signal.

15. The dipole antenna device of claim 14, wherein the dipole antenna device comprises a plurality of dipole antennas having known dimensions of separation and orientation with respect to the dipole antenna receiving the highest signal amplitude that provides multipath discrimination based on a signal amplitude and a signal phase of a signal received by one or more of the plurality of dipole antennas having known dimensions of separation and orientation with respect to the dipole antenna receiving the highest signal amplitude.

16. The dipole antenna device of claim 1, wherein an elevation angle is determined from the transmitted signal received at the dipole antenna device.

17. The dipole antenna device of claim 1, the integrated electronics further comprising a signal transmitter that is embedded within the space defined in part by at least one of a portion of the ground plane and a portion of the reflector.

18. The dipole antenna device of claim 17, the integrated electronics further comprising another wireless transmit and receive capability located on a peripheral boundary of the reflector such that it does not interfere with the antenna pattern of the dipole antenna device.

19. The dipole antenna device of claim 1, further comprising a radome covering the dipole antenna device, wherein the radome is made of a material having a low dielectric constant.

20. The dipole antenna device of claim 1, wherein an enclosure element which together with the portion of the ground plane and the portion of the reflector defines the space has a thickness sufficient to contain the integrated electronics at least in a direction parallel to the ground plane without adversely affecting the beam pattern of the dipole antenna device.

21. The dipole antenna device of claim 1, wherein an antenna-to-integrated electronics signal path has a loss of less than 0.5 dB.

22. The dipole antenna device of claim 1, wherein two or more dipole antenna devices are vertically stacked separated by a distance of about one half wavelength of the dipole antenna.

23. The dipole antenna device of claim 1, wherein two or more dipole antenna devices are stacked separated by a distance of greater than two wavelengths of the dipole antenna.

24. The dipole antenna device of claim 1, wherein two or more dipole antennas are formed in a diamond shape.

25. The dipole antenna device of claim 1, wherein two or more dipole antennas are formed in a linear manner with the reflector of each dipole antenna angled 45 degrees with respect to the angle of the dipole antenna device.

26. The dipole antenna array of claim 1, wherein adjacent dipole antennas are separated by a distance of greater than one quarter wavelength to less than one wavelength of the antenna to prevent ambiguity of phase.

27. A dipole antenna device, comprising:

a ground plane;

at least one dipole antenna comprising an active antenna element and a grounded antenna element, the active antenna element being isolated from the ground plane and extending in a direction substantially perpendicular to the ground plane, the grounded antenna element extending in a direction substantially opposite to the active antenna element, wherein a frequency range of signals received by said at least one dipole antenna is a function of a physical dimension of said at least one dipole antenna;

at least one reflector, wherein at least a portion of the around plane is contained within an area substantially bounded by the reflector;

integrated electronics comprising at least one of a signal down converter and a signal up-converter, wherein at least some of the integrated electronics are contained in a space defined by at least one of a portion of the ground plane and a portion of the reflector; and at least a first resonator located between an active antenna element and the reflector at an equal distance from the active antenna element and a rearmost portion of the reflector opposite the dipole antenna, wherein the physical dimensions of at least the first resonator enhances the frequency bandwidth and Voltage Standing Wave Ratio (VSWR) of the dipole antenna.

28. The dipole antenna device of claim 27, the first resonator comprising one of an active or passive resonator element that is isolated from the ground plane and extends in the same direction from the ground plane as the active antenna element and a grounded resonator element extending in an direction in the orthogonal ground plane directly opposite to the active or passive resonator element.

29. The dipole antenna device of claim 28, wherein the active element of the dipole is isolated from the ground plane using a material having a low dielectric constant.

30. The dipole antenna device of claim 28, wherein the first resonator is isolated from the ground plane with a material having a low dielectric constant.

31. The dipole antenna device of claim 28, wherein the thickness of the isolator above the ground plane for the active dipole element is less than ⅛ the wavelength of the highest frequency received by the dipole antenna element.

32. The dipole antenna device of claim 27, wherein the height of said at least one dipole antenna is equal to approximately ½ wavelength of the lowest frequency and the height of at least said first resonator is approximately ½ wavelength of the highest frequency, and wherein the bandwidth of the signals received is a function of the diameter of the dipole element and at least said first resonator.

33. A method of determining an azimuth to a source of a transmitted signal from a dipole antenna array, the method comprising:

receiving a transmitted signal at more than one dipole antenna elements of the dipole antenna array;

determining the dipole antenna element receiving the highest signal amplitude;

determining the adjacent dipole antenna element receiving the next highest signal amplitude;

determining an azimuth to the source of the transmitted signal from the dipole antenna array by comparing the signal amplitude and signal phase of the transmitted signal received at each of the two adjacent dipole antenna elements receiving the highest signal amplitude;

interfacing with a handheld device, and displaying the azimuth to the source of the transmitted signal from the dipole antenna array on the handheld device display.

* * * * *